US008095038B2

(12) United States Patent
Mizuno et al.

(10) Patent No.: US 8,095,038 B2
(45) Date of Patent: Jan. 10, 2012

(54) COMPACT IMAGING CARTRIDGE AND IMAGE FORMING APPARATUS

(75) Inventors: Hiroshi Mizuno, Aisai (JP); Isamu Kugimiya, Toyokawa (JP); Takeshi Hashimoto, Okazaki (JP); Naoto Yoshida, Toyokawa (JP); Nozomu Kondo, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 667 days.

(21) Appl. No.: 12/196,924

(22) Filed: Aug. 22, 2008

(65) Prior Publication Data

US 2009/0060567 A1 Mar. 5, 2009

(30) Foreign Application Priority Data

Aug. 27, 2007 (JP) ..... 2007-219831

(51) Int. Cl.
*G03G 15/08* (2006.01)

(52) U.S. Cl. ..... 399/120; 399/106; 399/35

(58) Field of Classification Search ..... 399/111, 399/113, 35, 120
See application file for complete search history.

(56) References Cited

U.S. PATENT DOCUMENTS

2006/0216063 A1* 9/2006 Okoshi ..... 399/111

FOREIGN PATENT DOCUMENTS

| | | |
|---|---|---|
| JP | 10-301380 | 11/1998 |
| JP | 10-319820 | 12/1998 |
| JP | 2005-140898 | 6/2005 |
| JP | 2005-227318 | 8/2005 |
| JP | 2006-267922 | 10/2006 |
| JP | 2007-52352 | 3/2007 |

OTHER PUBLICATIONS

Japanese Notification of Reason for Refusal mailed on Mar. 9, 2010, directed to counterpart Japanese Patent Application No. 2007-219831; 8 pages.

Japanese Notification of Reason for Refusal mailed on Aug. 25, 2009 directed at application No. 2007-219831; 13 pages.

* cited by examiner

*Primary Examiner* — David Gray
*Assistant Examiner* — Roy Y Yi
(74) *Attorney, Agent, or Firm* — Morrison & Foerster LLP

(57) ABSTRACT

An imaging cartridge includes an image carrier, a developing device, a cleaning device, a waste toner box, a communication section and transporter means. A communication section formed by positioning a first joint section of the cleaning device and a second joint section of the waste toner box in overlapping positions. Opposed faces of the first joint section and the second joint section are formed such that the first extended regions are gradually extended toward the image carrier and the second extended regions are gradually extended toward the opposed side of the image carrier.

7 Claims, 7 Drawing Sheets

COMPACT IMAGING CARTRIDGE AND IMAGE FORMING APPARATUS

BACKGROUND OF THE INVENTION

The present invention relates to an imaging cartridge and an image forming apparatus.

Conventionally, as image forming apparatuses equipped with imaging cartridges, the apparatuses structured so that component members having similar lifetime are packed into a process cartridge are known (see, e.g., JP 2006-267922 A, JP 2005-140898 A).

However, in the conventional structure, downsizing of the imaging cartridge has not been taken into consideration. Accordingly, image forming apparatuses which are loaded with a number of imaging cartridges have a problem that the entire apparatus grows in size.

SUMMARY OF THE INVENTION

Accordingly, an object of the present invention is to provide an imaging cartridge and an image forming apparatus which can be downsized even with simple structure.

As a means to accomplish the above object, there is provided, in the present invention, an imaging cartridge which can be loaded into and unloaded from an image forming apparatus body, including an image carrier, a developing device for developing an electrostatic latent image on the image carrier to form a toner image, a cleaning device for collecting toner which remains on the image carrier even after transfer of the toner image, a new toner box for storing toner fed to the developing device, and a waste toner box for storing the toner collected by the cleaning device, in which the image carrier, the developing device and the cleaning device are juxtaposed with the new toner box and the waste toner box, the cleaning device and the waste toner box are placed adjacent to each other, a first joint section of the cleaning device and a second joint section of the waste toner box are positioned so as to overlap each other in a direction perpendicular to an adjoining direction and are communicated through a communication section, opposed faces of the first joint section and the second joint section are formed in a state of being inclined with respect to the adjoining direction, and transportation means for transporting waste toner is housed in respective extended regions formed by inclining the opposed faces.

This structure makes it possible to secure the space which can house the transportation means without increasing the occupancy space in the overlapping direction of each joint section.

It is preferable that the transportation means is constituted of a conveying screw which is made of a spiral screw formed around a shank and which serves to transport waste toner from one end side of the shank toward the other end side, and the communication section is formed downstream in a transportation direction of the waste toner by the conveying screw.

This structure makes it possible to keep an opening area in the communication section small and to secure desired sealing property in the communication section easily at low costs.

It is preferable that a drum unit including the image carrier and the cleaning device is formed, a process unit including the new toner box, the waste toner box and the developing device is used, and the drum unit and the process unit are placed adjacent to each other and are detachably loaded.

This structure makes it possible to pack the components having similar lifetime into one unit. Since the new toner box and the waste toner box are integrated with each other, they can be handled conveniently.

It is preferable that a process unit including the image carrier, the developing device and the cleaning device is formed, a toner box unit including the new toner box and the waste toner box is formed, and the toner box unit and the process unit are placed adjacent to each other and are detachably loaded.

Since this structure makes it possible to load and unload only those members which serve to store toner as separate units, toner can be replaced easily.

It is preferable that the new toner box and the developing device are placed adjacent to each other and are also placed to overlap the cleaning device and the waste toner box, a third joint section of the new toner box and a fourth joint section of the developing device are positioned so as to overlap each other in a direction perpendicular to an adjoining direction, opposed faces of the third joint section and the fourth joint section are formed in parallel with opposed faces of the first joint section and the second joint section, and transportation means for transporting waste toner is housed in respective internal extended regions formed by inclining the opposed faces.

With this structure, it becomes possible to keep the occupancy space in the overlapping direction small not only in the joint section between the waste toner box and the cleaning device but also in the joint section between the new toner box and the developing device.

Also as a means to accomplish the above object in the present invention, an image forming apparatus includes any one of the imaging cartridges described above.

It is preferable that the image forming apparatus body, which the imaging cartridge can be loaded into and unloaded from, includes a cartridge receiving section having a mounting surface which is inclined with respect to a floor, and the communication section of the imaging cartridge is formed so as to extend in a perpendicular direction in a state of being attached to the cartridge receiving section.

With this structure, it becomes possible to move the toner with ease through a coupled section. That is, in the coupled section formed along with the perpendicular direction, the toner can smoothly be moved by its own weight almost without receiving frictional resistance. Therefore, problems such as clogging will not arise.

According to the present invention, the first joint section of the cleaning device and the second joint section of the waste toner box are structured to be connected to each other at their inclined opposed faces through the communication section, so that the extended region capable of housing the transportation means can be secured, making it possible to suppress increases in the occupancy space in the overlapping direction. In other words, it becomes possible to achieve downsizing of the imaging cartridge.

DESCRIPTION OF REFERENCE NUMERAL

Figure 1:
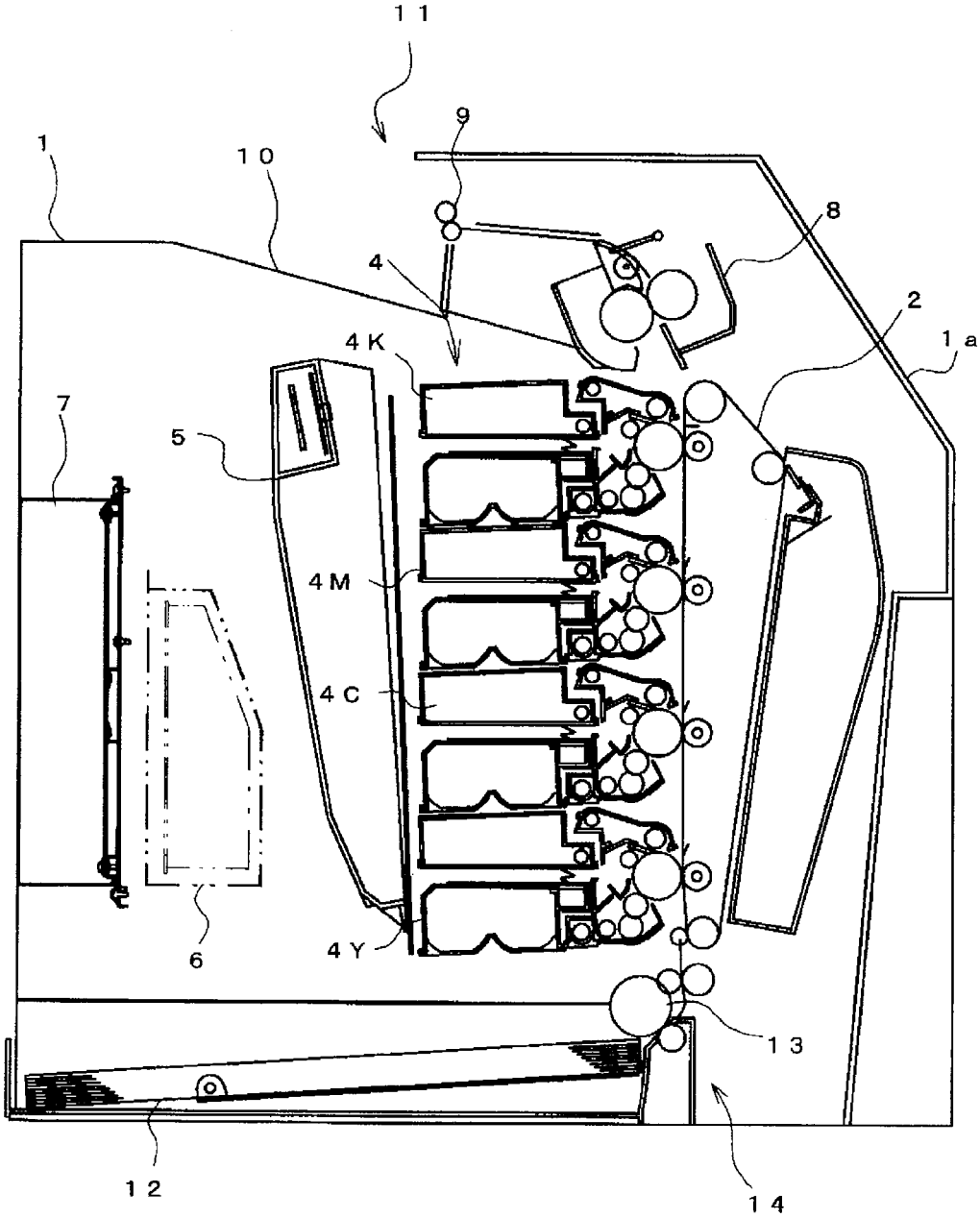
FIG. 1 is a schematic cross sectional view showing an image forming apparatus having an imaging cartridge in a first embodiment of the present invention.

1. Apparatus body
1*a*. Door
2. Transfer belt
3. Cartridge receiving section
4. Imaging cartridge
5. Laser exposure device
6. Electric power unit
7. Control device
8. Fixing device
9. Paper ejecting roller
10. Paper ejection tray
11. Paper ejection device
12. Paper cassette
13. Feed roller
14. Sheet feeding device
15. Photoconductor drum (image carrier)
16. Charging device
17. Developing device
18. Cleaning device
19. New toner box
20. Waste toner box
21. Transfer device
22. Timing roller
23. Drum unit
24. Process unit
25. Charging roller
26. Casing
27. First transportation member
28. Second transportation member
29. Collection port
30. Cleaner blade
31. First joint section
31*a*. Opposed face
32. First extended region
33. Delivery opening
34. Communication section
35. Feed roller
36. Developing roller
37. Second joint section
37*a*. Opposed face
38. Third transportation member
39. Second extended region
40. Reception opening
41. Third joint section
42. Fourth joint section
43. Fourth transportation member
44. Fifth transportation member
44. Sixth transportation member
50. Process unit
51. Toner bottle
52. Coupled section

DETAILED DESCRIPTION OF THE INVENTION

The embodiments of the present invention will be described hereinbelow with reference to the drawings.

FIG. 1 shows an image forming apparatus (tandem-type color laser printer) having an imaging cartridge 4 according to the first embodiment of the present invention.

Figure 2:
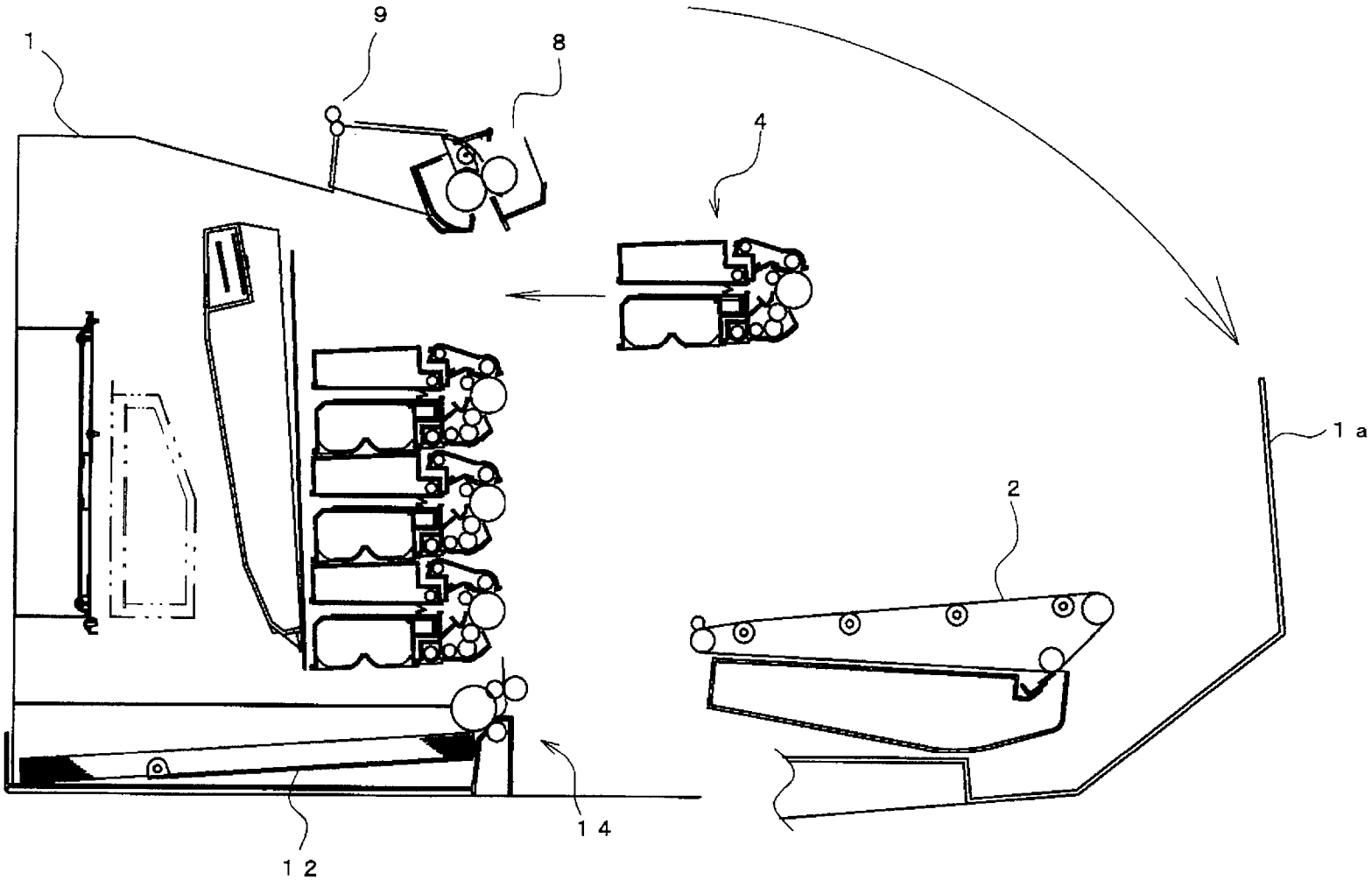
FIG. 2 is a schematic cross sectional view showing the image forming apparatus of FIG. 1 with a door opened.
Figure 4:
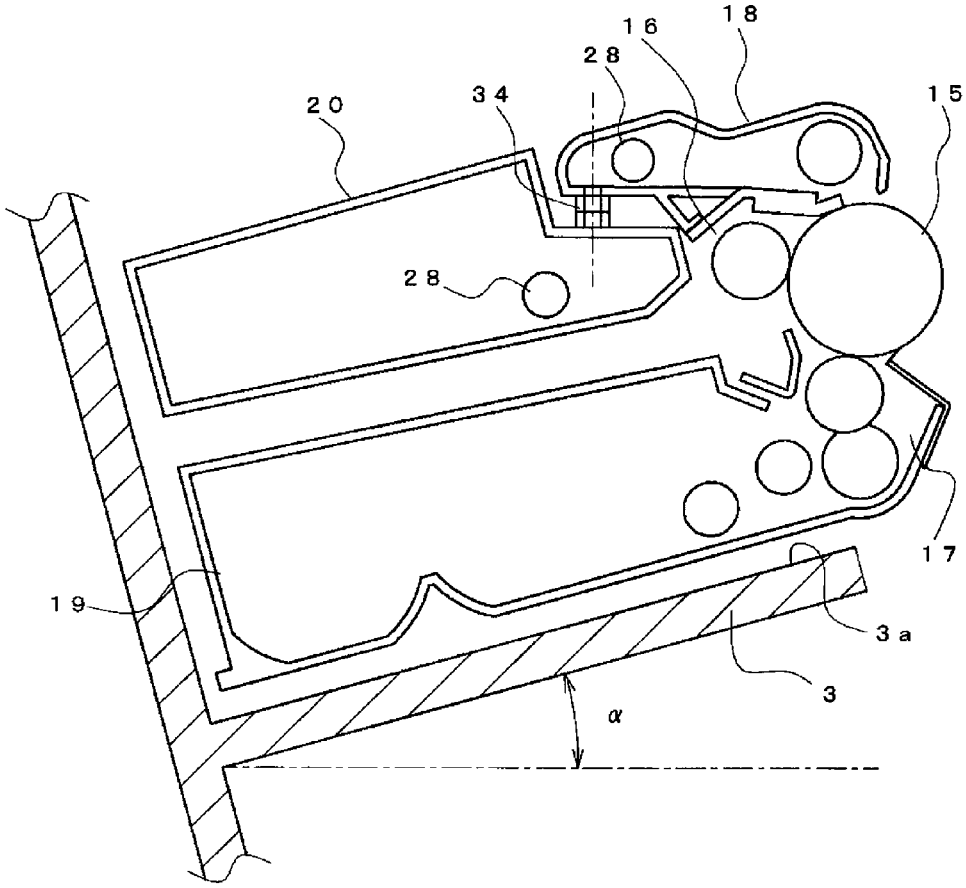
FIG. 4 is a schematic cross sectional view showing the imaging cartridge of FIG. 3 in the state of being attached to a cartridge receiving section of the apparatus body.

Inside an apparatus body 1 of the image forming apparatus, a transfer belt 2 stretched over a plurality of rollers is placed. Also inside the apparatus body 1, in a cartridge receiving section 3 (see FIG. 4) formed at the rear face side (left-hand side in FIG. 1) of the apparatus body 1 from the transfer belt 2, four imaging cartridges 4Y, 4C, 4M and 4K of yellow, magenta, cyan and black are detachably placed in the longitudinal direction. The cartridge receiving section 3 has a mounting surface 3*a* which is inclined with respect to the floor (level surface), i.e., inclined downward with respect to the loading direction of the imaging cartridge 4. Further, the apparatus body 1 accommodates a laser exposure device 5, an electric power unit 6 for supplying electric power to the entire apparatus, and a control device 7 for controlling operation of each section on the side further closer to the rear face side than the imaging cartridges 4Y-4K. A fixing device 8 and a paper ejection device 11 composed of a paper ejecting roller 9 and a paper ejection tray 10 are placed on the upper side of the apparatus body 1. A sheet feeding device 14 composed of a paper cassette 12 and a feed roller 13 is placed on the lower side in the apparatus body 1. The paper cassette 12 can be attached to and detached from the front-face side (right-hand side in FIG. 1) of the apparatus body 1. A door 1*a* which can be rotated around an unshown pivot so as to be opened and closed is provided on the front-face side of the apparatus body 1, and the transfer belt 2 is placed in the door 1*a*. As shown in FIG. 2, as the door 1*a* is opened, the transfer belt 2 is put in a retreating position, where the imaging cartridges 4Y-4K can be loaded onto and unloaded from the front-face side of the apparatus body 1.

Figure 3:
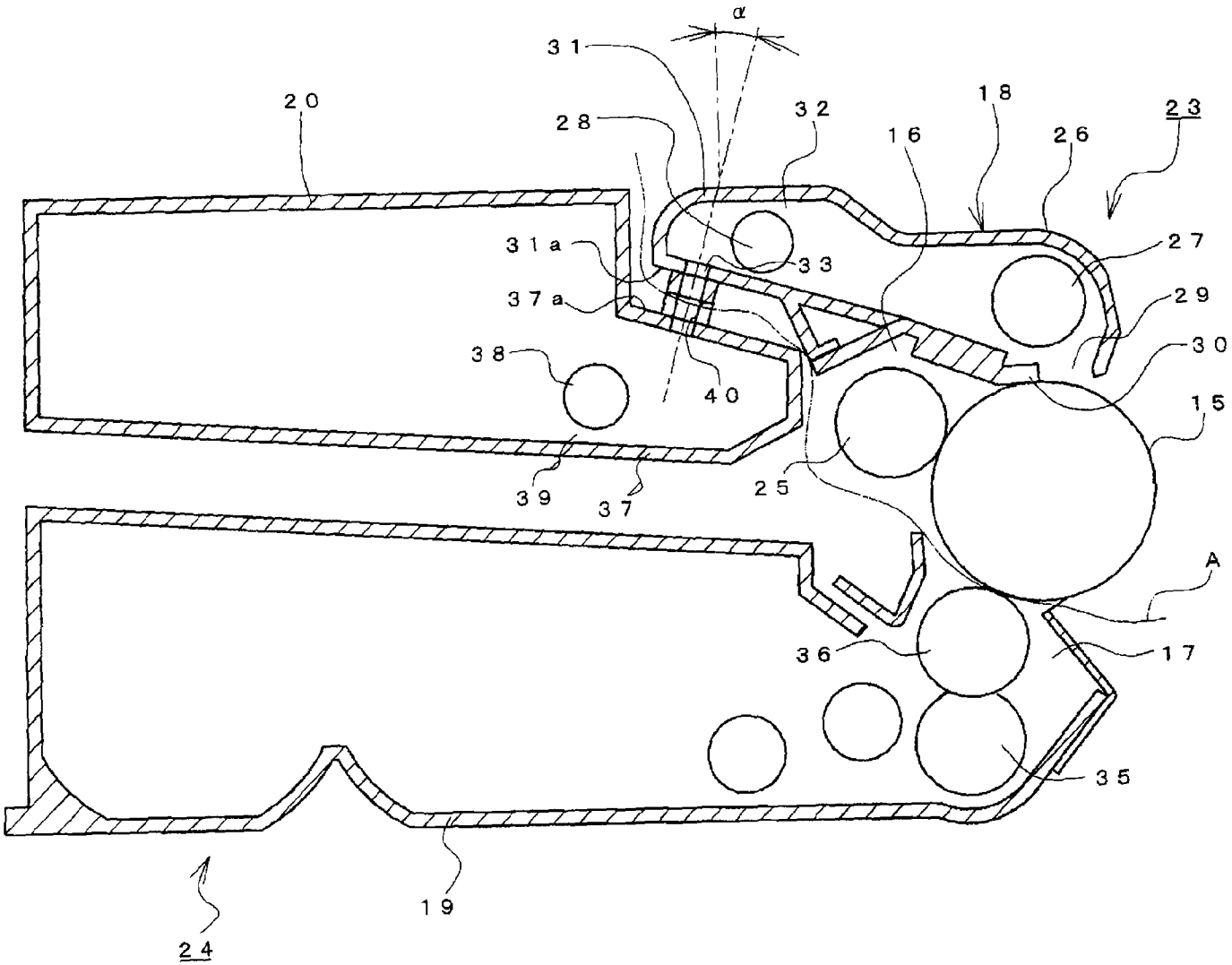
FIG. 3 is a schematic cross sectional view showing the imaging cartridge of FIG. 1.

Each of the imaging cartridges 4Y-4K are composed of, as shown in FIG. 3, a charging device 16, a developing device 17 and a cleaning device 18 which are placed around a cylindrical photoconductor drum 15 (image carrier) provided in a rotatable manner, as well as a new toner box 19 for storing unused toner (new toner), and a waste toner box 20 for storing used toner (waste toner). Toner of one corresponding kind among yellow, magenta, cyan, and black is stored in the new toner box 19 in each one of the imaging cartridges 4Y-4K. The transfer roller 21 is each placed so as to face the photoconductor drum 15 of each of the imaging cartridges 4Y-4K across the transfer belt 2.

Brief description is now given of the process in each of the imaging cartridges 4Y-4K. First, the photoconductor drum 15 is charged by the charging device 16, and then is irradiated with a laser beam from the laser exposure device 5 to form an electrostatic latent image on the photoconductor drum 15 based on an image signal. With the toner fed from the new toner box 19, the developing device 17 develops the electrostatic latent image on the photoconductor drum 15 to form a toner image. The tone that remains on the photoconductor 21 even after transfer of the toner image to a paper sheet or a recording medium P is collected by the cleaning device 18 and stored in the waste toner box 20.

The image forming apparatus is a type of the apparatus which feeds the recording medium P from the paper sheet cassette 12 to the front-face side and transports it upward while forming an image thereon, before discharging it to the rear face side. More specifically, the recording medium P sent out from the paper sheet cassette 12 to the front-face side sheet by sheet by the feed roller 13 passes through a timing roller 22 before being electrostatically held by the transfer belt 2, and is transported upward. Whenever the recording medium P passes through between the photoconductor drum 15 in each imaging cartridges 4Y-4K and the corresponding transfer rollers 21, a toner image of one color is transferred onto the recording medium P. The recording medium P with toner images transferred thereon in superimposition one on another by the imaging cartridges 4Y-4K is transported to the fixing device 8, where toner images are fixed by heating and pressurization, and then the recording medium P is discharged by the paper ejecting roller 9 to the paper ejection tray 10.

Description is now given of the imaging cartridges 4Y-4K in detail. Hereinafter, when it is not necessary to distinguish four imaging cartridges 4Y-4K, reference numeral "4" is used to denote the imaging cartridge 4.

The imaging cartridge 4 is composed of a drum unit 23 and a process unit 24 which are provided in a detachable manner.

The drum unit 23 is composed of a photoconductor drum 15, a charging device 16 and a cleaning device 18. The charging device 16 incorporates a charging roller 25 for charging the photoconductor drum 15. The cleaning device 18 houses a first transportation member 27 and a second transportation member 28 in a casing 26. A collection port 29 is formed in one end side of the casing 26, where a cleaner blade 30 is provided. The cleaner blade 30 can slide on the peripheral face of the photoconductor drum 1 as the photoconductor drum 1 rotates, and collects the waste toner which remains on the photoconductor drum 15. The first transportation member 27 has a plurality of blades formed around its shank along its axial center. The first conveyance member 27 is placed in the vicinity of the collection port 29 with its axial center extending in the width direction of the casing 26. As the first conveyance member 27 rotates, the waste toner collected from the collection port 29 is transported to a delivery opening 33 side of the casing 26. The second transportation member 28 has a spiral blade (screw) around its shank. The second transportation member 28 is placed in the vicinity of the delivery opening 33 so that its axial center extends in the width direction of the casing 26. As the second transportation member 28 rotates, the waste toner transported by the first conveyance member 27 is transported from one end side of the shank to the other end side.

Figure 5:
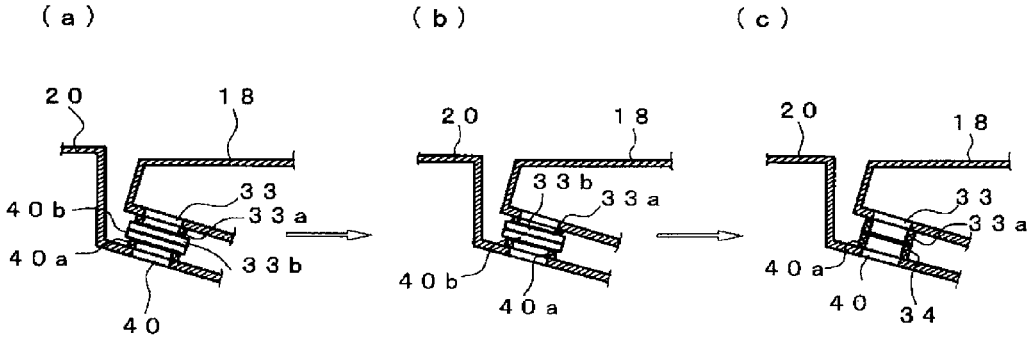
FIG. 5 is a schematic cross sectional view showing a coupled section and the vicinity thereof in assembling the imaging cartridge of FIG. 3.

The other end side of the casing 26 constitutes a first joint section 31. In the first joint section 31, the lower surface forms an opposed face 31*a* which is gradually inclined upward. Thereby, a first extended region 32 which is gradually extended toward a base section is formed in the internal space of the first joint section 31. The first extended region 32 secures a space which can accommodate the second transportation member 28. The opposed face 31*a* has a delivery opening 33 formed downstream in the transportation direction of the waste toner by the second transportation member 28. As shown in FIG. 5, a PET film stuck on the surface of a sealing member 33*a* which is made of elastically deformable resin (e.g., urethane foam material) and which is in a rectangular frame shape is stuck on the opening edge at the delivery opening 33. The opening formed by the sealing member 33*a* is openable and closable by a shutter 33*b*. Moreover, the sealing member 33*a* constitutes a communication section 34 together with a later-described sealing member 40*a* of the waste toner box 20.

The process unit 24 is composed of a new toner box 19 and a waste toner box 20, which are coupled to each other by an unshown support member in a manner allowing elastic relative displacement. The new toner box 19 has an internal space for storing uncharged new toner. Moreover, a feed roller 35 and a developing roller 36 are incorporated in one end side of the new toner box 19. The developing roller 36, which is placed at the diagonally lower side of the photoconductor drum 15, feeds toner onto the photoconductor drum 15 so as to develop an electrostatic latent image to form a toner image. The waste toner box 20 is so structured that one end side is constituted of a second joint section 37 and the other end side incorporates a third transportation member 38. In the second joint section 37, the upper surface forms as opposed face 37*a* which is gradually inclined upward. Thereby, a second extended region 39 which gradually extended toward a base section is formed in the internal space of the second joint section 37 as with the case of the first joint section 31. The second extended region 39 secures a space which can accommodate the third transportation member 38. Moreover, the opposed face 37*a* faces the opposed face of the first joint section 31 at a prescribed interval, where a reception opening 40 which faces the delivery opening 33 is formed. As shown in FIG. 5, a sealing member 40*a* having the same structure as the delivery opening 33 is also stuck on the opening edge of the reception opening 40. The opening formed by the sealing member 33*a* is openable and closable by a shutter 40*b*. The waste toner which has entered via the reception opening 40 is transported to the opposite side of the reception opening 40 while being diffused by rotation of the third transportation member 38.

The above-structured imaging cartridge 4 is formed by assembling the drum unit 23 which is made up of the photoconductor drum 15, the charging device 16 and the cleaning device 18, and the process unit 24 which is made up of the new toner box 19 and the waste toner box 20. In this case, the developing roller 36 of the new toner box 19 is positioned in the vicinity of the diagonally lower side of the photoconductor drum 15, while the waste toner box 20 is adjacent to the lateral side of the casing 26 of the cleaning device 18. An inclined opposed face is formed in the first joint section 31 of the casing 26, while a similar opposed face is also formed in the second joint section 37 of the waste toner box 20, and these opposed faces are placed so as to face each other as shown in FIG. 5A. Then, as shown in FIG. 5B, the sealing member 33*a* of the first joint section 31 and the sealing member 40*a* of the second joint section 37 come into pressure contact with each other, by which successful sealed condition is established. At this point, when the shutters 33*b* and 40*b* are opened, a communication section 34 for communicating the delivery opening 33 and the reception opening 40 is formed by the sealing members 33*a* and 40*a* as shown in FIG. 5C.

Figure 6:
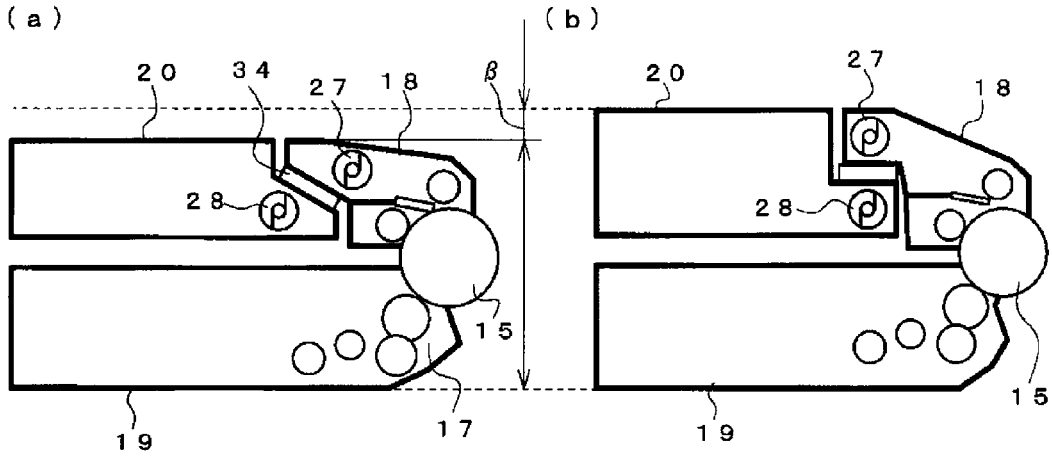
FIG. 6 is a schematic cross sectional view showing the imaging cartridge of FIG. 3 in comparison with an imaging cartridge different in structure.

The imaging cartridge 4 assembled in this way has the vertical size limited by the opposed faces 31*a* and 37*a* formed in the first joint section 31 and the second joint section 37 as shown in FIG. 6A. Therefore, as shown in FIG. 6B, it becomes possible to form the imaging cartridge 4 smaller by a prescribed size β than an imaging cartridge without such structure.

The imaging cartridge 4 having the above structure is used in the state of being attached to a cartridge receiving section 3 of the apparatus body 1. A mounting surface 3*a* of the cartridge receiving section 3 is formed in the state of being inclined by a predetermined angle α with respect to the level surface. The angle of inclination α is preferably 18-45 degrees. It is to be noted that the effect of decreasing the height size can be maximized with only the imaging cartridge 4 by setting the angle of inclination a to 45 degrees. Also, loading of imaging cartridge 4 into the apparatus body 1 can be facilitated by setting the angle of inclination α to 18-30 degrees. In the state where the imaging cartridge 4 is loaded into the apparatus body 1, the imaging cartridge 4 is also inclined so that the communication section 34 extends in the perpendicular direction. In other words, the communication section 34 enables the waste toner to smoothly move from the first joint section 31 to the second joint section 37 even if the waste toner has fluidity poorer than normal toner. It is to be noted that it becomes possible to achieve smooth free fall of the toner by setting the direction of the communication section 34 in the range of ±15 degrees from the perpendicular direction.

Description is now given of the operation of the image forming apparatus with the above structure. In the following section, description is mainly given of the collection method of the waste toner which characterizes the present invention, and therefore description of other aspects will be omitted.

The waste toner which remains on the photoconductor drum 15 without being transferred onto a recording medium P is scraped by the cleaner blade 30, and is collected into the casing 26 of the cleaning device 18 via the collection port 29. The waste toner collected in the casing 26 is transported by rotation of the first transportation member 27 to the first joint section 31 on the other end side. In the first joint section 31, the transported waste toner is collected from the one end side to the other end side, i.e., to the delivery opening side, by rotation of the second transportation member 28.

Since the communication section 34 extends vertically downward, the waste toner collected at the delivery opening side moves to the reception opening 40 smoothly, and flows into the second joint section 37 of the waste toner box 20. In the second joint section 37, the waste toner inflow is transported so as to be diffused in an axial direction (to the side opposite to the second transportation member 28) and to the other end side of the waste toner box 20 (to the side opposite to the second joint section 37) by rotation of the third transportation member 38. Thus, it becomes possible to put the waste toner into a uniform state within the waste toner box 20 and to transport it to the other end side.

Second Embodiment

Figure 7:
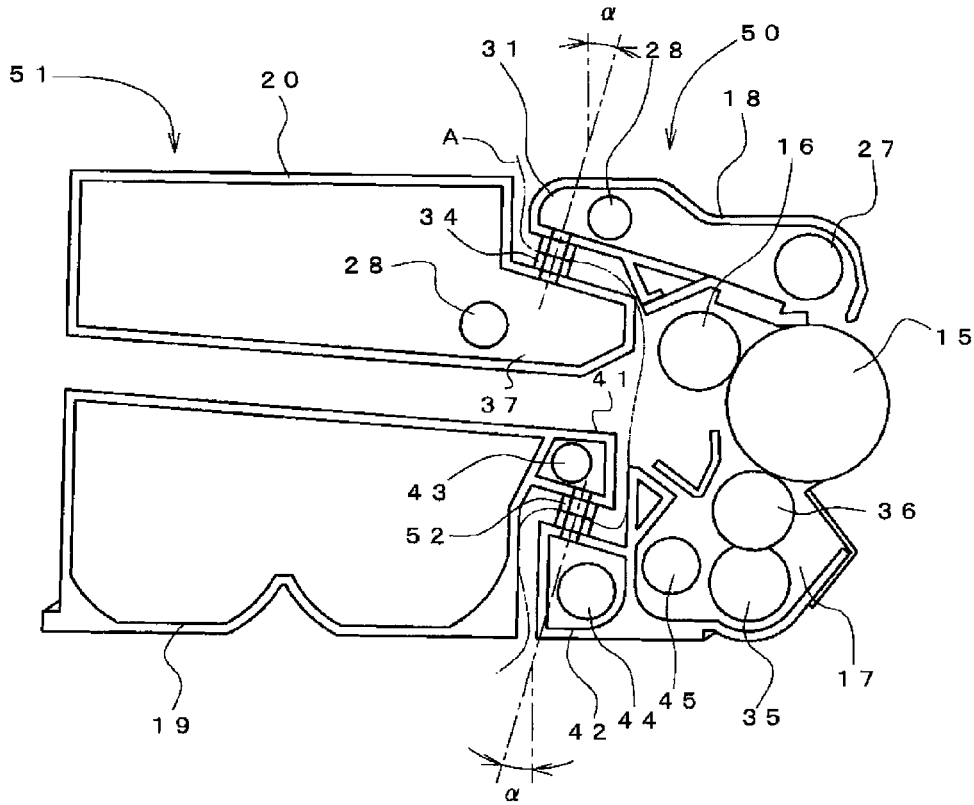
FIG. 7 is a schematic cross sectional view showing an imaging cartridge in a second embodiment of the present invention.

FIG. 7 shows an imaging cartridge 4 in the second embodiment of the present invention. The imaging cartridge 4 is structured so that a process unit 50 made up of a developing device 17, a photoconductor drum 15, a charging device 16 and a cleaning device 18 is detachably juxtaposed with a toner bottle 51 made up of a new toner box 19 and a waste toner box 20.

The new toner box 19 and the developing device 17 are placed adjacent to each other, while a third joint section 41 constituting one end side of the new toner box 19 and a fourth joint section 42 constituting one end side of a casing 26 of the developing device 17 are placed so as to overlap each other in a vertical direction.

In the third joint section 41, the lower surface forms an opposed face which is gradually inclined downward toward the top end. Therefore, an extended region is formed not in the base section side as seen in the first joint section but in the top end side of the third joint section 41. A fourth transportation member 43 is placed in the extended region. The fourth transportation member 43, like the second transportation member 28, transports new toner from one end side toward the other end side within the third joint section 41, and moves the toner to the fourth joint section 42 via a coupled section 52 provided on the other end side.

Also in the fourth joint section 42, the upper surface forms an opposed face which is gradually inclined upward toward the top end. Also in the fourth joint section 42, as in the third joint section 41, an extended region is formed in the top end side, where a fifth transportation member 44 is placed. The fifth transportation member 44, like the third transportation member 38, transports the new toner which flowed therein via the communication section 34 in the axial direction and to the side of a sixth transportation member provided in the vicinity thereof.

Figure 8:
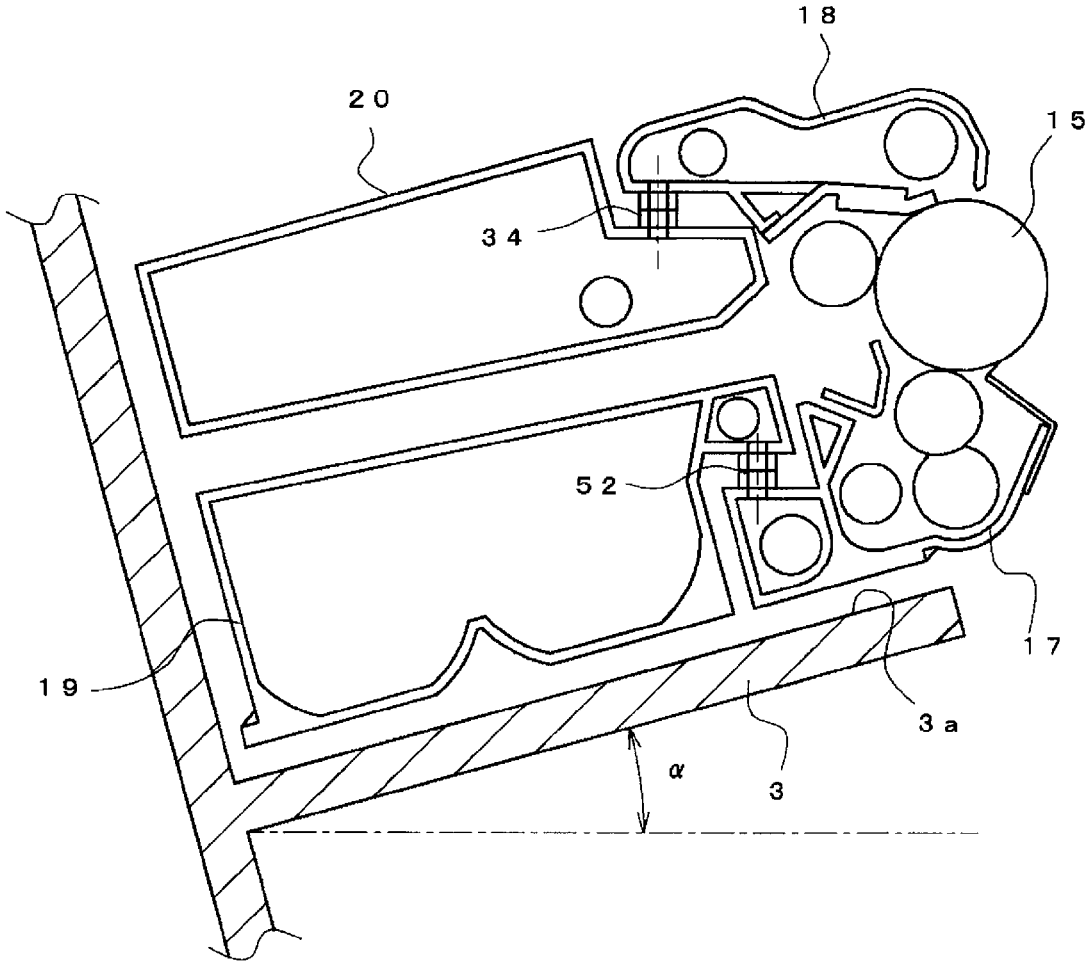
FIG. 8 is a schematic cross sectional view showing the imaging cartridge of FIG. 7 in the state of being attached to a cartridge receiving section of the apparatus body.

According to the imaging cartridge 4 having the above structure, the overlapped state of the third joint section 41 and the fourth joint section 42 is almost identical to the overlapped state of the first joint section 31 and the second joint section 37, and as shown in FIG. 8, upon attachment of the imaging cartridge 4 to the cartridge receiving section 3 of the apparatus body 1, it becomes possible to orient both the coupled sections in the respective joint sections in a perpendicular direction. In addition, in both the new toner and the waste toner, the coupled sections 34 and 52 are formed vertically downward from the upstream side to the downstream side in the transportation direction, so that transportation is carried out smoothly in either position.

Third Embodiment

Figure 9:
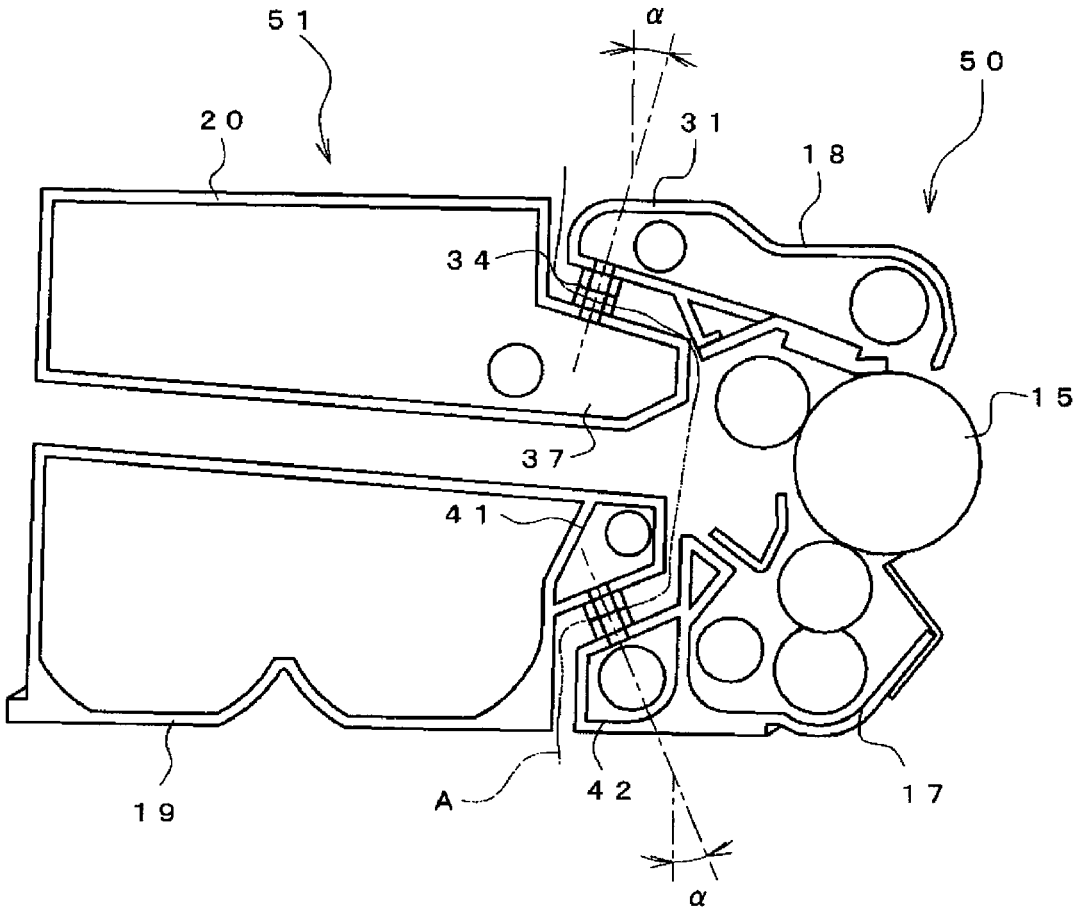
FIG. 9 is a schematic cross sectional view showing an imaging cartridge in a third embodiment of the present invention.

FIG. 9 shows an imaging cartridge in the third embodiment of the present invention. The imaging cartridge 4 is identical to that of the second embodiment in the point that they are composed of the process unit 50 and the toner bottle 51 and their only difference is the structure of the third joint section 41 and the fourth joint section 42. That is, the lower surface of the third joint section 41 and the upper surface of the fourth joint section 42 form opposed faces which gradually incline upward toward the top end (right-hand side in FIG. 9), their inclination direction being reverse of the inclination direction of the first joint section 31 and the second joint section 37.

According to this structure, the vertical occupancy space of one end side of the toner bottle, which is constituted of the first joint section 31 and the fourth joint section 42, is gradually decreased toward the top end, so that easy loading and unloading of the process unit 24 and the toner bottle can be achieved.

The present invention is not limited to the embodiments disclosed but accommodates various modifications. Although the present invention has been explained by taking the printer of the direct transfer method as an example, the present invention can also be applied to image forming apparatuses of the indirect transfer method in which a toner image is primarily transferred onto an intermediate transfer belt from each imaging cartridge 4 and the toner image on the intermediate transfer belt is secondarily transferred onto a recording medium. The present invention is also applicable to image forming apparatuses other than printers, such as copying machines, facsimile transceivers and multi-functional machines.

What is claimed is:

1. An imaging cartridge which can be loaded into and unloaded from an image forming apparatus body, comprising:

an image carrier;

a developing device for developing an electrostatic latent image on the image carrier to form a toner image;

a cleaning device for collecting toner which remains on the image carrier even after transfer of the toner image;

a waste toner box for storing the toner collected by the cleaning device, wherein the cleaning device and the waste toner box are placed adjacent to each other;

a communication section formed by positioning a first joint section of the cleaning device and a second joint section of the waste toner box in overlapping positions;

transporter means for transporting the waste toner that is housed in first extended region formed at the side of the image carrier against the first joint section in the cleaning device and second extended region against the second joint section in the waste toner box respectively, wherein opposed faces of the first joint section and the second joint section are formed such that the first extended region are gradually extended toward the image carrier and the second extended region are gradually extended.

2. The imaging cartridge according to claim 1, wherein the transportation means comprises a conveying screw which is made of a spiral screw formed around a shank and which serves to transport waste toner from one end side of the shank toward the other end side, and wherein the communication section is formed downstream in a transportation direction of the waste toner by the conveying screw.

3. An imaging cartridge according to claim 1 or 2, wherein a drum unit including the image carrier and the cleaning device is formed, a process unit including the new toner box, the waste toner box and the developing device is formed, and the drum unit and the process unit are placed adjacent to each other and are detachably loaded.

4. An imaging cartridge according to claim 1 or 2, wherein a process unit including the image carrier, the developing device and the cleaning device is formed, a toner box unit including the new toner box and the waste toner box is formed, and the toner box unit and the process unit are placed adjacent to each other and are detachably loaded.

5. The imaging cartridge according to claim 4, wherein the new toner box and the developing device are placed adjacent to each other and are also placed to overlap the cleaning device and the waste toner box, wherein a third joint section of the new toner box and the fourth joint section of the developing device are positioned so as to overlap each other in a direction perpendicular to an adjoining direction, wherein opposed faces of the third joint section and the fourth joint section are formed in parallel with opposed faces of the first joint section and the second joint section, and wherein transportation means for transporting waste toner is housed in respective internal extended regions formed by inclining the opposed faces.

6. An image forming apparatus, comprising the imaging cartridge according to any one of claims 1 or 2.

7. The image forming apparatus according to claim 6, wherein the image forming apparatus body, which the imaging cartridge can be loaded into and unloaded from, comprises a cartridge receiving section having a mounting surface inclined with respect to a floor, and wherein the communication section of the imaging cartridge is formed so as to extend in a perpendicular direction in a state of being attached to the cartridge receiving section.

* * * * *